United States Patent [19]

Marse

[11] 4,216,967

[45] Aug. 12, 1980

[54] PRESIDENT ELECTION GAME

[76] Inventor: Salvador Marse, 320 South Harrison St., East Orange, N.J. 07018

[21] Appl. No.: 909,518

[22] Filed: May 25, 1978

Related U.S. Application Data

[63] Continuation-in-part of Ser. No. 756,775, Jan. 5, 1977, Pat. No. 4,092,028, and Ser. No. 789,098, Apr. 20, 1977, Pat. No. 4,118,036.

[51] Int. Cl.[3] ..... A63F 3/00

[52] U.S. Cl. ..... 273/257; 273/DIG. 26

[58] Field of Search ..... 273/257, 279, 282, 287, 273/250–253

[56] References Cited

U.S. PATENT DOCUMENTS

| | | | |
|---|---|---|---|
| 1,616,216 | 2/1927 | Dempsey | 273/279 |
| 1,907,255 | 5/1933 | Ferrari, Jr. | 273/279 |
| 2,693,961 | 11/1954 | Ripley, Jr. | 273/256 |
| 2,930,621 | 3/1960 | Gross et al. | 273/257 |
| 3,368,816 | 2/1968 | Milazzo et al. | 273/257 |
| 3,899,176 | 8/1975 | Gregan | 273/287 |

*Primary Examiner*—Richard C. Pinkham
*Assistant Examiner*—Scott L. Brown
*Attorney, Agent, or Firm*—Leonard W. Suroff

[57] ABSTRACT

A presidential election game in which the fifty states and the District of Columbia are divided into color coordinated zones. The game board has a score tabulation on each state playing space which records the amount of popular votes each player has received in each state. The game board also has a score tabulation for each player to record the changing number of electoral college votes that each player has accumulated until a winner is elected and becomes the President of The United States of America.

25 Claims, 12 Drawing Figures

PRESIDENT ELECTION GAME

CROSS-REFERENCE TO RELATED APPLICATIONS

This application is a continuation-in-part of my copending applications Ser. No. 756,775, filed Jan. 5, 1977, now U.S. Pat. No. 4,092,028, issued May 30, 1978; and Ser. No. 789,098, filed Apr. 20, 1977, now U.S. Pat. No. 4,118,036, issued Oct. 3, 1978, which entire subject matter of the copending applications is incorporated herein by reference as if fully set forth herein.

BACKGROUND OF THE INVENTION

1. Field of the Invention

This invention relates to a game and more particularly to an educational and entertaining game played on a board with movable pieces in association with said board.

More specifically, the present game is directed to American politics and enables the players thereof to compete for the Presidency of The United States of America through involvement in a presidential political campaign and in so doing to increase their appreciation and knowledge of the importance and implications of the electoral college system and the vote apportionment connected therewith.

2. Description of the Prior Art

Presidential election games have been disclosed in the prior art, for example, in U.S. Pat. Nos. 753,949; 2,043,482; 3,318,601; and 3,368,816. In contrast to the above, I have invented a novel game that utilizes gaming pieces that move to and from areas corresponding to states and the District of Columbia as one would through an election when the votes are being tallied. Furthermore, there has been provided in my game, posting means, which may form part of the game board, for continuous updating and tabulation of the number of popular and/or electoral votes of each player.

The advantages and distinctions of my invention over the prior art will become more clearly evident as the disclosure proceeds.

OBJECTS OF THE INVENTION

An object of the present invention is to provide a political game in which the winner becomes elected President.

Another object of the present invention is to provide apparatus to permit a number of players to participate in an election, with the excitement of winning the election State by State.

Other objects and advantages of the present invention will become apparent as the disclosure proceeds.

SUMMARY OF THE INVENTION

A presidential election game for one of the players to win and thus become "President" of the USA, which game comprises in combination a playing board of any suitable material, having its periphery divided into a series of outer zones or columns and a series of inner zones or columns intersecting the board, with the zones or columns being divided into a series of color playing squares, or boxes, corresponding to the fifty states plus other squares which may be designated as follows: One for the District of Columbia, one for the White House, one named "Convention Hall", and two assigned and named "Outlying U.S. Areas".

Each color playing zone or square has a color designation with a specific meaning that will hereinafter be discussed. Each color playing zone in the board game corresponding to a state and D.C. has numerical indicium being designative of the number of electoral college votes allocated to each one of them, and also the name and capital city of the state, the number of inhabitants (1970 census) in each one, and the ideal number of electors or voters eligible to vote in that particular state and District. Obviously these census and ideal elector numbers will require periodic revision at least every four years.

All other playing zone areas have some pertinent information written on them. For example, "Convention Hall" is the starting square of the game in accordance with one embodiment of the present invention. Also the rearrangement of the squares in the zones or columns can be altered. A map of the United States is disposed centrally on the playing board, with the boundaries of each state and D.C. being outlined on the map. The names or abbreviations of the state or D.C. will appear in each corresponding space in the map. The states and D.C., and other areas if desired, will be divided into different groups by color designation, similar to the ones on the color playing zones on the playing board. These states on the map and D.C. are divided according to their population and for electoral college vote representation.

Each voting zone area has indicium thereon which is a numbered guide as to the possible votes that may be needed by a player to win the state or D.C. according to the number of players of the game. The game is played by at least two players.

A map is disposed centrally of the playing board that has the boundaries of each state in the map outlined thereon, the states being identified by name. The states are divided into different groups by color designation according to their population and for electoral college votes representation. During playing of the game each player is to receive a marker that may take various forms well known in the art. During play of the game the marker is first placed on a starting zone and then moves from zone to zone of each state or other areas through pathways that are provided and which join the color playing zones together.

Chance means operable by the players of the game are provided so as to produce a random number for determining the number of zones the player may advance. The chance means may be in the form of a pair of dice. Chance cards are provided and are picked by a player depending upon certain numbers obtained when the pair of dice are thrown. The states and D.C. in the central map and corresponding color squares zones may be grouped into seven different color groups with the number of states in each group varying from two up to sixteen states.

In the game board different colored pathways appear, red and white being illustrated in the present embodiment, but they can be altered as to number and color, between adjoining zones on the game board. There will be a varied number of the chance cards, each chance card having indicia thereon representative of an advantage one player may exercise over another player or a hazard that a player must suffer. In the present style of the game these chance cards are divided into two groups in which sixteen cards are in each group. Indicia and number of cards can vary.

The chance means operable by players of the game apparatus are provided so as to produce a random number for determining the number of color playing squares the player may advance, with posting means for indicating the number of popular and/or electoral college votes posted by a player as the game progresses, and a marker for each player that differs in color and configuration. The markers are placed initially on the designated starting area; in one illustrated embodiment it is labelled "Convention Hall". Each player moves progressively from color playing zone to color playing zone on the pathways of the game board by utilization of the chance means and accumulating votes in order to win the election and become "President".

BRIEF DESCRIPTION OF THE DRAWINGS

Although the characteristic features of this invention will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

DETAILED DESCRIPTION OF THE DRAWINGS

Figure 1:
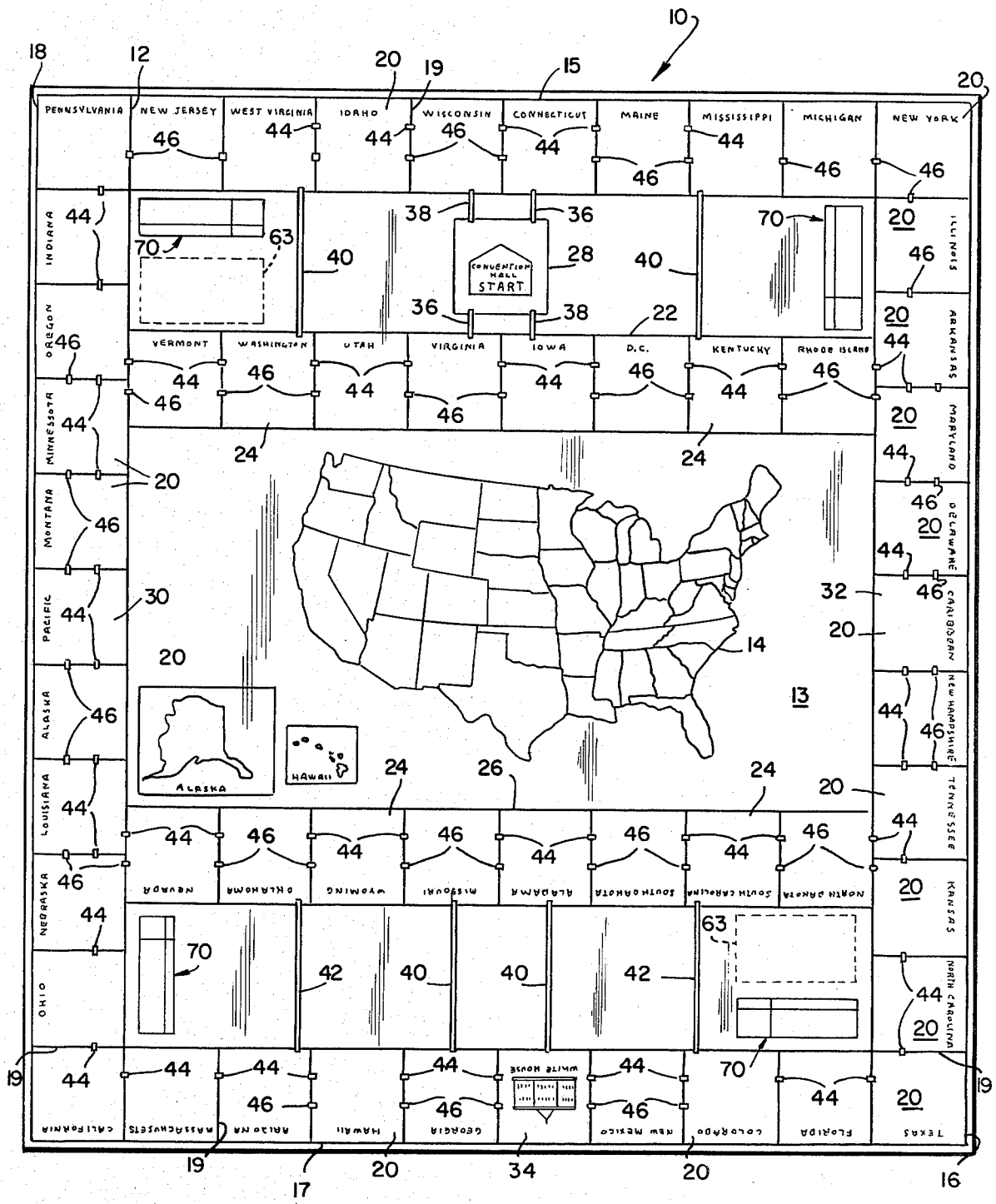
FIG. 1 is a plan view of the playing board in accordance with the present invention.

Referring to the drawings, FIGS. 1 through 10 illustrate the novel combination provided in the presidential election game 10 which includes a game board 12 made of any suitable material and being generally rectangular in configuration, having a playing surface 13 thereon. The playing surface 13 is provided with a central map 14 of the United States that would include all of the fifty states, as well as the District of Columbia. The game board 12 has sides 15, 16, 17 and 18. Around the periphery of the game board 12 are a series of outer or peripheral columns 19 of outer squares or zones 20 extending along each of the sides 15, 16, 17 and 18 of the periphery of the game board 12. The outer zones 20 of progression are arranged about each side 15, 16, 17 and 18 of the periphery of the game board 12 to form a generally closed figure of four sides.

A first column 22 comprised of a series of inner zones 24 extends across the game board 12 and contiguous to a pair of columns 19 forming the outer zones 20 along spaced apart sides 16 and 18 of the game board 12. A second column 26 comprised of a series of inner zones 24 extends across the playing board 12 in spaced apart substantially parallel spaced relation to the first column 22 of the inner zones 24 and contiguous to a pair of outer columns 19 forming the outer zones 20 along spaced apart sides 16 and 18 of the game board 12.

A starting zone 28 on the game board 12, which is the starting position from which play of the game is commenced, is provided and positioned intermediate one of the columns 22 or 26 of the inner zones 24 and one of the columns 19 of the outer zones 20. As illustrated in FIG. 1, the starting zone 28 is situated between first column 22 and outer column 19. The starting zone 28 is entitled "Convention Hall Start".

The outer zones 20 may further include particular squares that are not one of the states or D.C. Outlying areas are identified by square 30 entitled "PACIFIC" and square 32 entitled "CARIBBEAN". In addition, square 34 is provided as one of the outer zones 20 and may be entitled "WHITE HOUSE". Accordingly, the outer zones 20 and inner zones 24 comprise at least fifty-one voting areas comprising the fifty states and the District of Columbia.

To permit movement from the starting zone 28, there are provided first lanes 36 and 38 connecting the starting zone with the outer zones 20 and inner zones 24 on opposite sides thereof. In this manner a path of travel is available from the starting zone 28. In addition, second lanes 40 and 42 are provided and extend between certain of the inner zones 24 and outer zones 20. To provide movement between adjoining zones 20 and 24, there are provided pathways 44 and 46.

Figure 2:
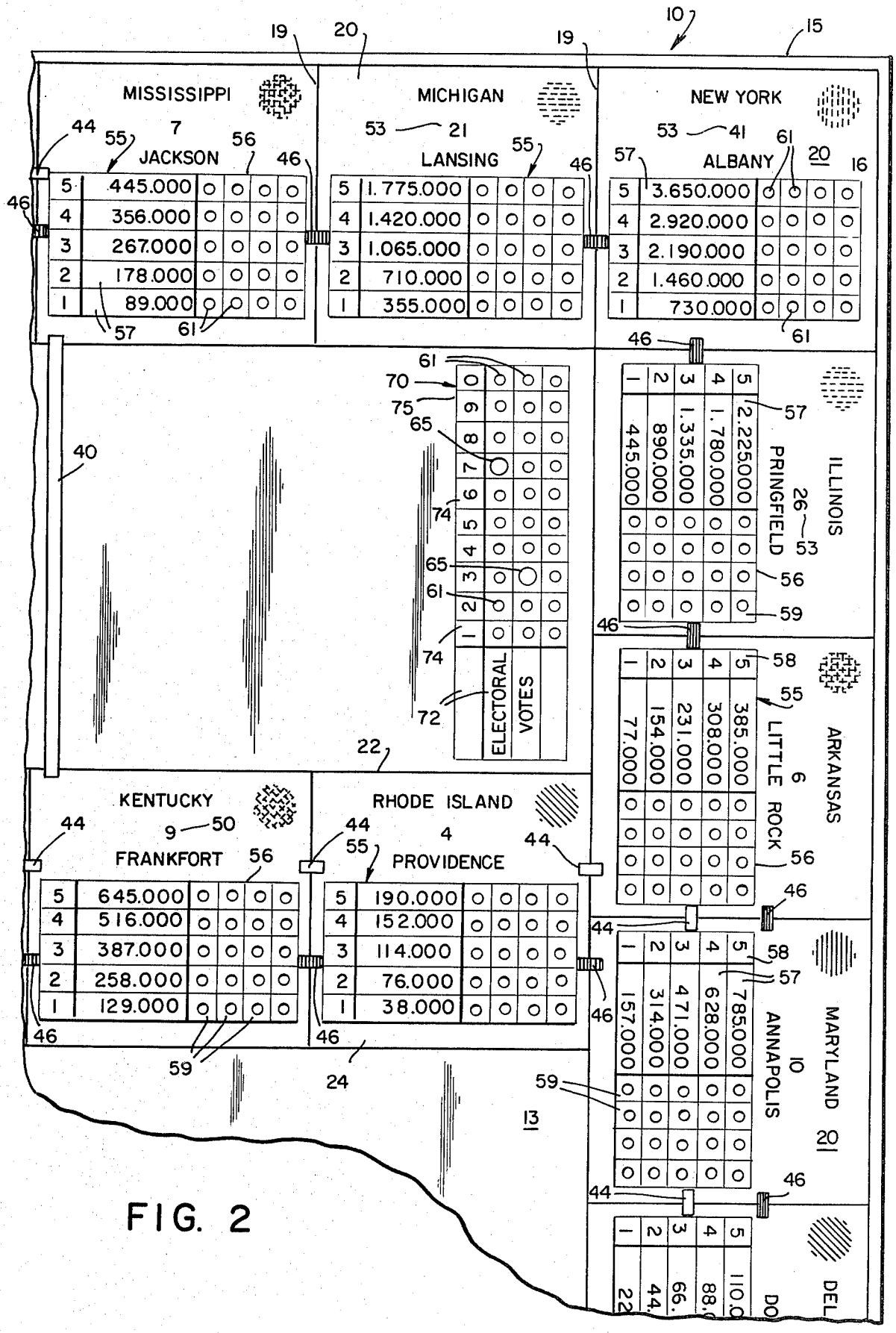
FIG. 2 is an enlarged fragmentary plan view of one corner of the board illustrated in FIG. 1, the lettering on the respective spaces or areas being clearly represented and the distinctive colors being indicated thereon according to the chart for draftsmen in the Patent Office Rules of Practice.
Figure 3:
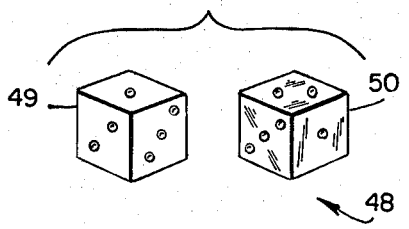
FIG. 3 shows a perspective view of a pair of dice which may be used as the chance means to determine the extent or length of the moves of the players along the path or course.

To control the path through which movement is obtained, there is provided chance means 48 that is operable by players of the game 10 so as to produce a random number for determining the number of zones that a player may advance. The chance means 48 may comprise a pair of dice identified as first chance means or die 49 and second chance means or die 50. Each die 49 and 50 is preferably differently coded. For example, the first chance means 49 may be coded and used for the level of votes obtained within a state, and the second chance means 50 may be differently coded and used to determine the number of moves of a player. It is also possible that the die 49 may be equivalently coded in matching conformity with first lane 38, second lane 40, and pathway 44. As illustrated in FIG. 2, the color coding for these particular areas on the playing board may be white in color. In a similar fashion, die 50 may be red in color and the corresponding first lane 36, second lane 42, and pathway 46 may have corresponding color indicium.

Figure 11:
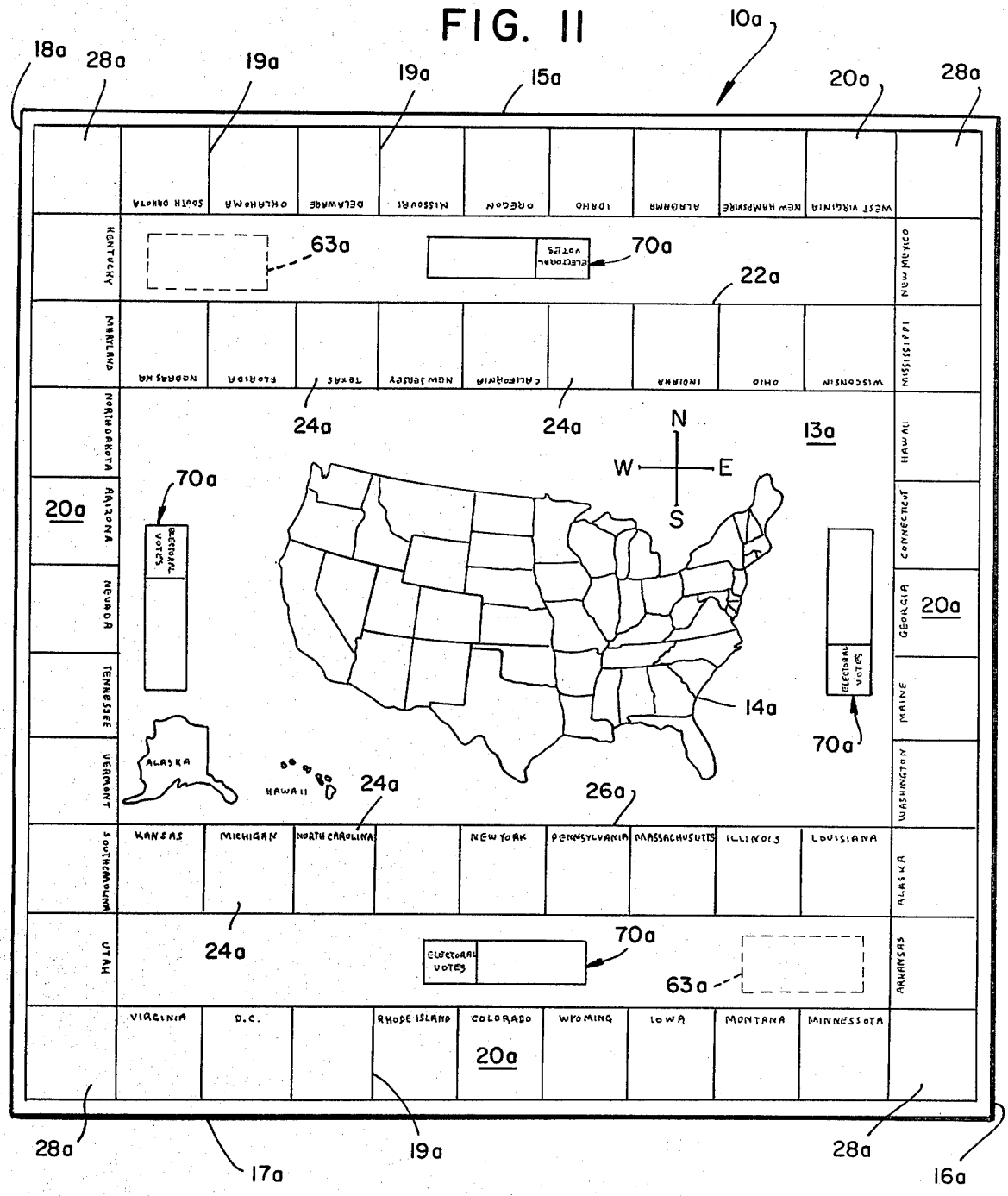
FIG. 11 is a plan view of the playing board in accordance with another embodiment of the present invention.

The purpose of setting apart die 49 and 50 from each other is that upon a roll of the dice 48, the die having the largest number appearing thereon is the particular path that the player must follow by movement of the markers or symbols identified by numeral 51 illustrated in FIG. 11. It is appreciated that each marker 51 for each player may differ in color or configuration. Each marker 51 is placed initially on the starting zone 28 by each player and progressively moved from zone to zone by utilization of the second chance means 50 through the lanes and pathways.

Accordingly, if die 50 has the higher number thereon, the player must move his marker 51 through either lanes 36 or 42 as well as pathway 46. As illustrated in FIG. 2, the arrangement between zones 20 and 24 is such that certain pathways 46 are only situated between certain zones 20 such that it is more difficult to reach certain states.

The respective states and D.C. are divided into groups which are distinguishable from each other by the color selected. The color coding is illustrated on FIG. 2, and the fifty states and D.C. are divided into seven different color groups. The U.S. outlying areas 30 and 32, as well as the White House 34, may be included in these groups. Each of the state zones and D.C. includes first numerical indicium 53 contained on each of the zones 20 and 24. The first numerical indicium 53 being designative of the number of popular and/or electoral college votes allocated to each of the voting areas. The first numerical indicium 53 illustrated in FIG. 2 indicates the number of electoral college votes allocated thereto, and may also include the population.

For example, as illustrated in FIG. 2, zone 20 representing New York has first numerical indicium 53 indicating 41 electoral college votes. This apprises each player in a simple manner of the value of winning a particular state. Second numerical indicium 57 is contained on each of the zones 20 and 24 and is designative of the possible number of minimum popular votes needed to respectively win a particular voting area.

The information contained below relates to the grouping of the voting areas and the preferable color identification of each group. It is appreciated that the color coding may be changed as well as the states in each group.

Group. I. Green—Total 16 states (including D.C.) Population in these areas ranges from 300,000 people to 1 million people more or less, and Electoral College Vote (E.C.V.) ranges from 3 to 4.

1. Utah
2. New Mexico
3. Hawaii
4. Nevada
5. Wyoming
6. Idaho
7. Alaska
8. Montana
9. North Dakota
10. South Dakota
11. New Hampshire
12. Rhode Island
13. Delaware
14. D.C.
15. Vermont
16. Maine Group II. Yellow—Total 8 states. Population ranges from 1.5 million to 2.2 million people, and E.C.V. ranges from 5 to 8.

1. Arizona
2. Colorado
3. Oregon
4. Nebraska
5. West Virginia
6. Kansas
7. Arkansas
8. Mississippi Group III. Orange—Total 7 states. Population in these areas ranges from 2.6 million to 3.4 million more or less, and E.C.V. ranges from 8 to 9.

1. South Carolina
2. Kentucky
3. Alabama
4. Oklahoma p1 5. Washington
6. Iowa
7. Connecticut Group IV. Pink—Total 8 states. Population in these areas ranges from 3.6 million to 4.7 million more or less, and E.C.V. ranges from 10 to 12.

1. Georgia
2. Tennessee
3. Louisiana
4. Missouri
5. Minnesota
6. Wisconsin
7. Maryland
8. Virginia Group V. Red—Total 5 states. Population in these areas ranges from 5.2 million to 7.2 million people more or less, and E.C.V. ranges from 13 to 17.

1. Indiana
2. Massachusetts
3. New Jersey
4. North Carolina
5. Florida

Group VI. Blue—Total 5 states. Population in these areas ranges from 8.9 million to 11.7 million people more or less, and E.C.V. ranges from 21 to 27.

1. Illinois
2. Michigan
3. Ohio
4. Pennsylvania
5. Texas

Group VII. Purple—Total 2 states. Population in these areas ranges from 18 to 20 million people, and E.C.V. ranges from 41 to 45.

1. New York
2. California

In addition, the outlying U.S. areas identified by zones 30 and 32 have no electoral votes and may be color coded by a brown color.

By dividing the zones 20 and 24 into different groups as enumerated above, it is possible for each player in a simple manner by following the color of the zones to make a determination as to the value of a particular voting area that the player is attempting to win. Each player is permitted to move a respective marker 51 through the various pathways 44 and 46. It will be noted that pathways 44 may be considered a first group and pathways 46 a second group. The first group 44 connects certain contiguous zones 20 and 24. The second group 46 connects other contiguous zones 20 and 24. Certain of the zones 20 and 24 are connected by pathways from each of the groups 44 and 46.

In this manner a degree of difficulty is provided in reaching certain voting areas. In a similar fashion the first lanes are similarly divided into the two distinguishable sets which are indicated by numerals 36 and 38. Similarly, the second set of lanes is also divided into the two distinguishable sets 40 and 42. As discussed above, the chance means 48 is matched with respect to these lanes and pathways to control the route that the markers 51 may follow.

The above discussed game board 12 provides alternate courses for each marker 51 to follow, and the player may select his or her own strategy as to which voting area one desires to win on the election road in becoming "President".

The map 14, which is disposed centrally of the playing board 12, has the boundaries of each state in the map 14 outlined thereon. The states are identified by name (not shown). The states are divided into different groups by color designation according to their population and for electoral college votes representation. The color selected for the different states on map 14 may correspond to the colors selected for the respective zones 20 and 24 identified above and divided into the seven groups.

Figure 4:
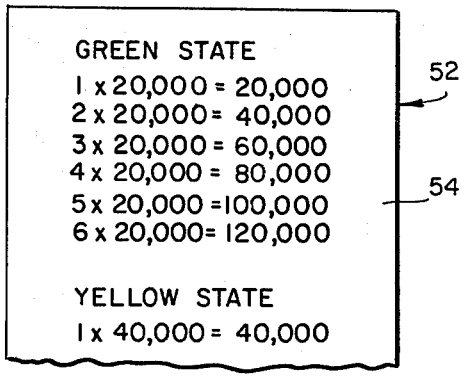
FIG. 4 is a plan view of one of a number of indicating cards having information contained thereon bearing different basic multiple numbers for each color group of states that can be used by the players to obtain the votes.
Figure 5:
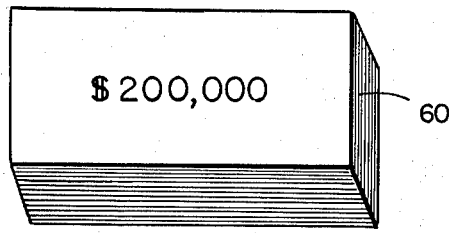
FIG. 5 is a perspective view of money available for use with the game.
Figure 8:
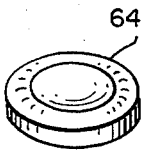
FIG. 8 shows a perspective view of a colored winning chip used in the game.

To aid the player to be informed of the number of votes that is required to win a state, there may be provided indicating means 52 illustrated in FIG. 4. The assisting means 52 may be in the form of a card 54 that matches the color groups of the zones 20 and 24. The card 54 is identical to the color groups on the playing surface 13 with votes assigned to each group, such that the player can see the total vote count obtained on usage of the chance means 48, if this is desired.

The assisting means 52 matches the color coding of the various groups and may have "basic multiples" assigned to each group. For example, if die 49 is thrown and a five is the number thrown, and we are dealing with a "Green" state, then the player would receive 50% of the votes necessary to win. In this manner the card 54 aids the players in playing the game. The speed at which the game is played is interrelated to the number of votes possibly obtained upon each throw of the dice 48. Therefore, the number of votes allotted or the basic multiple may be varied depending upon how fast one desires to play the game. The game is capable of being played without the assisting means 52 if so desired by use of the indicating means 56 as hereinafter described in detail.

The marker 51 for each player differs in color or configuration, with the marker 51 placed initially on the starting square 28 by each player and progressively moving from zone to zone by utilization of the chance means 48 through the pathways 44 and 46, as well as first lanes 36 and 38; and second lanes 40 and 42; and accumulating popular votes and winning enough states with enough number of electoral votes in order to win the election and become "President". A source of money 60, illustrated in FIG. 5, may be distributed to each player for use during the game.

Figure 6:
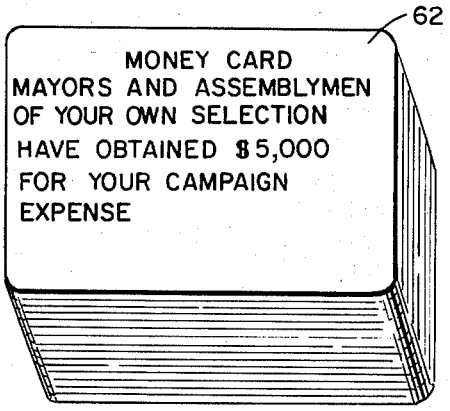
FIG. 6 is a perspective view of one set of chance cards which are supplied with the game.
Figure 7:
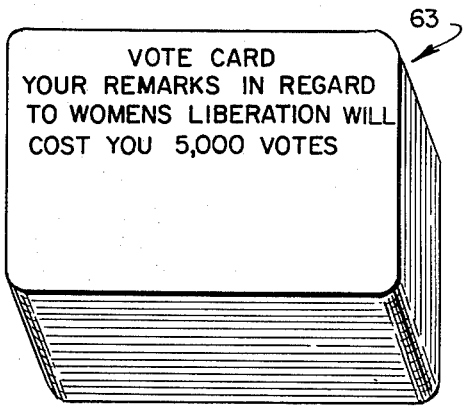
FIG. 7 is a perspective view of another set of chance cards which are supplied with the game.
Figure 9:
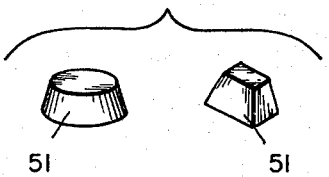
FIG. 9 is a perspective view of a playing piece utilized by the players during the game.

To further make the game interesting, at least one set of chance cards is provided. As illustrated, a first set of chance cards 62 is illustrated in FIG. 6 and a second set of chance cards 63 is illustrated in FIG. 7. The respective sets 62 and 63 may be positioned in diagonally opposite corners of the playing surface 13, as illustrated in FIG. 1. The sets of chance cards 62 and 63 have indicia thereon representative of an advantage one player may exercise over another player or a hazard that a player must suffer.

As the game progresses, it is often desirous of quickly determining which player has won a particular state. Towards this end there is provided a plurality of distinguishable chips 64 distributed to each of the players at the start of the game for use in conjunction therewith. The set of chips 64 for each player may be appropriately identified by color, symbol, etc. In this manner when the player wins a particular state, his identifying chip may be placed thereon.

Voting or tabulation means 55, as illustrated in FIG. 2, is provided in each of the zones 20 and 24 that is a state or the District of Columbia to aid in play of the game 10. The voting means 55 includes indicating means 56 which may be in the form of a voting box having a series of horizontal columns 57 having indicating means or voting indicia 58 therein specified as numerals "1", "2", "3", "4", and "5". These numerals may represent 10%, 20%, 30%, 40% and 50%, respectively, of the electoral vote and/or popular vote of each voting area or zone. Adjacent to or forming part of the voting box 56 is a plurality of four vertically extending columns 59 extending in parallel spaced relationship to the voting indicia 58. Four columns 59 are provided, one for each player. Each column 59 has a plurality of apertures or recesses 61 provided therein. Each recess 61 is adapted to receive the marking means in the form of indicators or elements 65 illustrated in FIG. 10. Four marking elements 65 may be provided that are distinguishable from each other in color or configuration, one for each player.

Each marking element 65 may have a stem 66 that is adapted to be readily positioned within a recess 61. In this manner an individual tally of each state or voting district may be readily maintained by the players. As indicated, the die 49 has the identification for numerals "1", "2", "3", "4", "5", and "6". These numerals represent 10%, 20%, 30%, 40%, 50%, and 60% of the vote. In this manner by a throw of dice 49 and 50 the number of votes obtained per voting district and the number of moves of the marker 51 are obtained. For example, when die 49 lands on a "six", then the player would win 60% of the vote and win the state. If the first chance means 49 lands on a "two", then a player would win 20% of the votes of the state and move the marking element 65 up the column 59 until a player has obtained either 50% or more of a state.

Accordingly, as the game progresses each player may in sequence throw the dice 49 and 50. The die 50 determines the number of moves the player may make. The die 50 may be color coded on different surfaces thereof to indicate if path 40, 42, 44, or 46 is to be followed. If desired, the interconnecting paths 40, 42, 44, and 46 may be of the same color and then die 50 would not have to be coded on different surfaces thereof.

In this manner use of the chance means is obtained by one throw of the dice 48 to determine concurrently the number of moves of a marker 51 and the number of votes that the player obtains in the voting area on which he or she lands.

As the game progresses, it is important that a tally is maintained of the votes each player is accumulating in the fifty-one voting areas, and accordingly posting means 70, illustrated in FIG. 1, is provided. The posting means 70 may be provided on the game board 12 and include horizontal columns 72 and cross-columns 74 with the numerals or numbers 1, 2, 3, 4, 5, 6, 7, 8, 9, and 0 thereon. The posting means 70 is provided adjacent the four corners of the gameboard to provide one for each player. The posting means may be bounded by a posting box 75 as illustrated in FIG. 2 and include a plurality of apertures for which the marking elements 65 may be used. Each player will have three marking elements 65 to keep score with. As illustrated in FIG. 2, in the posting means 70 therein, the player has accumulated seventy-three electoral votes. This arrangement is used by each player until one accumulates sufficient electoral votes to win the game.

Accordingly, the posting means 70 is utilized for indicating the number of electoral votes posted by a player as the game progresses, and includes the tabulation means 55 for the individual states.

In playing the game each player rolls the pair of dice 48 when their turn comes up and advances to the color playing zone the player wishes or can reach depending upon the number of the die 50. Upon landing on zones 20 and 24 representing any of the fifty-one voting areas, the player calculates the number of votes obtained on that throw, by use of die 49 which acts as the indicating means 56. In this simple manner the player can determine how many popular votes and/or electoral votes were obtained on that throw for a particular voting area.

The basic numbers set forth on each die 49 is such that the highest number, six, the player can roll on a particular throw of the dice 48 is equal to 60% of the vote and sufficient to win the voting area. The numbers of only one die 49 are utilized. On the tabulation or posting means 70 the number of electoral votes gained by each player when a voting area is won is posted. It is appreciated that the popular vote concept may be followed, rather than the electoral vote as is used today. In which case the player winning the largest number of popular votes will become "President".

The indicating means 55 is used such that the highest number the player rolls with the die 49 results in a vote count obtained in that throw of the die 49. On the tabulation or posting means 70 the number of electoral votes gained by each player on winning a state is posted. This will vary as the game progresses for each player. The pieces 65 are posted as the electoral votes per player change.

Players roll the die 48 and advance with certain privileges whenever they roll a double, for example, they can advance along either colored pathway 44 or 46; or lanes 36, 38, 40, and 42; or can draw a chance card 62 or 63. Some chance cards 62 or 63 have advantages, others have disadvantages to the player and/or his opponents. They deal with transference of votes, loss or gaining extra votes, also missing or taking throws. They also deal with money matters (e.g. money 60 obtained through special ways for votes, etc.).

The money 60 is distributed to each player at the start of the game. As the game progresses players keep adding votes to the states they reach, and upon winning some states the number of electorial votes are added and posted on their respective areas using the posting means 70. Each player has to have votes in a minimum number of states, preferably thirty, in order to qualify to become President. The votes needed to win in each state have been determined by a percentage of the ideal number of voters in each state and based on census population and general USA voting trends in past elections. Each player is represented by his or her own marker 51, each one in a different color, and winning chips 64, which are to be placed in the state each player wins, are given to each player.

Starting point in the embodiment of FIGS. 1 and 2 may be the Convention Hall square 28. The states in the map 14 are represented in the zones 20 and 24 around and intersecting the game board in the form of colored playing squares, and these colored playing squares have information in regards to the number of electoral votes alloted to each state or D.C. The name of the state and the name of the capital city of each state may be provided in each voting zone, as illustrated in FIG. 2. The number of electoral votes illustrated herein is by population according to census 1970, and both the ideal number of voters and population according to census will require periodic revisions.

RULES OF PLAY OF FIGS. 1 AND 2

The rules of play may be contained in special instructions to provide the players with the necessary guidance in playing the game. Additional aspects of the game are identified in conjunction with the rules of play.

Set forth below are various instructions and aspects to the present invention which are interrelated with the structure described above in order to obtain the game 10 with its various aspects to it.

I. OBJECT: The aim of the game is to become President of the U.S.A. by winning a majority (or plurality if such is the case) of the electoral votes of all the players. The number of electoral votes needed to win depends on the number of players. To accomplish this, a player has to win a certain number of states (by a majority or plurality of the popular votes in each state) whose electoral college vote total will enable the player to obtain that majority or plurality. However, the tally of this is not mandatory except:

(A) If necessary to resolve a tie (state or presidency) between two or more players. (See Sections: V-N, V-O, V-P)

(B) If the players agree at the beginning of the game to tally them.

(C) A President-elect is in debt for one million dollars or more. (See Sections V-M, V-K)

(D.) The President-elect does not have electors in at least thirty states. (See Section V-M)

II. PLAYERS: In the present format of the game, from two to a maximum of four single players can play the game. (The maximum number of single players can be subject to be increased provided other criteria of the game are altered.)

III. IMPLEMENTS:

(A) One large multi-colored board 12 of any suitable material marked appropriately for the game, as illustrated in FIGS. 1 and 2.

(B) Four different colored markers or tokens 51. In the present embodiment of the game they are white, blue, red, and yellow.

(C) Play money—In the present arrangement of the game, the money 60 is of different denominations in the following quantities and colors:

| | Quantity | Denomination | Color |
|---|---|---|---|
| | 10 | $500,000 | gold |
| | 30 | 200,000 | green |
| | 50 | 100,000 | blue |
| | 90 | 50,000 | pink |
| Total | 180 | | |

(D) Four sets of different colored winning chips 64 ("WC") are provided. These may correspond to the different colored tokens or markers of each player. In the present style of the game thirty (30) WC are given to each player. (The amount given can vary.) But let's state that only one set of fifty-one (51) WC in a neutral color (for example, gold) can be used for all the players. These WC are placed in the state or D.C. voting areas to show that that state has been won.

(E) An amount (quantity will vary) of marker elements 65 are utilized by placing them on the tabulation means 55 and posting means 70 to keep the score of electoral college/popular votes. The marker elements 65 are readily moved as the score changes as the game progresses.

(F) Two stacks or sets 62 and 63 of marked playing or chance cards with written information on them, representative of an advantage one player may exercise or a hazard or penalty he must suffer. The indicia on these cards are subject to variation. In the present game form these two stacks are named:

(1) Vote Cards—sixteen of each (2) Money Cards—sixteen of each

The number of chance cards 62 and 63 and indicia thereon can vary.

(G) One or four "rapid vote calculation card(s)" (RVCC) or assisting means 52 may be utilized. In the present form of the game the card is in a neutral color or in white. If there is only one it is to be shared by all the players. Or if preferred, a different card with the same information can be given to each player, but each card if desired may have the color background corresponding to the color of the token 51 each player has.

(H) Posting means—The number of popular votes and/or electoral college votes gained by each player are posted. This will vary as the game progresses for each player. The tabulation means 55 in the present arrangement consists of a posting box 56 with the name of the state and D.C. on one side and also four different colored columns or zones alloted for posting each player's score in that voting area. Each column will have a different color background corresponding to the player's token color. Also, the posting means 70 provides for the totals of electoral college votes.

(I) Chance means 48 of different colored dice 49 and 50 is to be shared by all the players. There can be one white background die 49 with black dots on each surface and one red background die 50 with white dots on each surface. The dots vary like on any other ordinary die; with six sides and dots ranging accordingly from one to six. The color and number of dice 48 can be subject to change. Also, if desired, each player may be provided with a pair of dice 48.

(IV) BEGINNING OR PREPARATION (STARTING) OF THE GAME:

(A) Place the game board 12 on a table or suitable playing surface. Position the two sets of playing cards 62 and 63 face down in their assigned spaces.

(B) Select a player or nonplayer (observer) to be the Federal Election Commissioner. His duties consist of: posting the tallies on the tabulation means 55 and acting as a banker, (i.e., collecting penalties, distributing the money, etc.). If the players so agree, these duties can be shared or divided by one or more players or a nonplayer.

(C) Each player chooses a colored marker 51 to represent him in the game. This is done by accorded selection or by chance, for example, rolling the highest number with one die.

(D) Each player is given play money 60 to a total amount of four million dollars to each one. According to the present game format, but this can vary, each player receives:

| | |
|---|---|
| Two $500,000 bills totaling $1,000,000.00 | (Gold) |
| Five $200,000 bills totaling $1,000,000.00 | (Green) |
| Ten $100,000 bills totaling $1,000,000.00 | (Blue) |
| Twenty $50,000 bills totaling $1,000,000.00 | (Pink) |

All the remaining money is to be given to the Federal Election Commissioner.

(E) A pair of different colored dice 48 is to be shared by all players or as stated in Section III-I each player can have his or her own pair.

(F) Each player or the Federal Election Commissioner will be in charge of the posting means 70.

(G) The different colored WC are distributed to each player for their accorded use. If only one set of neutral colored WC (see Section III-D) are used, then the Federal Election Commissioner will be responsible for their control. If when playing the game with different colored WC (see Section III-D) and a player has won more states than he has of individual colored WC, he may borrow some unassigned colored WC.

(H) Players are given a rapid vote calculation card or assisting means 52 (see Section III-G).

V. PLAYING THE GAME:

(A) Each player places his marker 51 in area 28 denoted as "Convention Hall". Name or starting place can vary.

(B) Each player in accorded turn rolls one die 49 or 50, and the player with the highest number goes first, then the others follow in turn in a counter-clockwise manner. In case of a tie for the first position spot, the players involved throw the die again until the tie is resolved. The higher one is first, and he or she starts. The one that comes in second in the tie breaker has the option to be second, but he has to situate himself next to the person who goes first in a counter-clockwise position. If he declines this, then he plays in his natural seating order.

(C) When the player rolls the dice 48, he follows the color lanes and pathways between adjacent areas, state to state, to Convention Hall, to Outlying U.S. Areas, to the White House, of the same color as the background of the die 50 with the higher number which is rolled. The smaller number does not count as far as advancing the marker 51 is concerned.

(D) When the player completes his moves along the lanes 36, 38, 40, or 42, or pathways 44 and 46, he will land in a zone 20 or 24 of a certain color, as descirbed in the seven Groups defined above. He can go through or land in any of these zones if he so needs, desires, wishes, or is permitted by the rules of the game. Two or more players may share a given zone at one time.

(E) A player can go straight forward or backward in any direction he so desires or is allowed to in each turn, but a player may not go back and forth (backtrack) between pathways connecting two adjacent color playing zones in one turn.

(F) After a player completes his move and arrives on a color playing zone, he then examines the die 49 and the number indicated will be equivalent to 10%, 20%, 30%, 40%, 50%, or 60% of the votes necessary to win the voting area. If desired the assisting means may contain the information as on the indicating means.

(G) Now the Federal Election Commissioner or individual player (see Sections IV-B and IV-F) will use the marking elements 65 in the posting means 70 to keep individual score. Whenever a player is subjected to penalties he may have to subtract some votes from the tabulation means or posting means 70.

(H) When a player rolls a double, he has the privilege of moving along either colored pathway 44 or 46 or lanes 36, 38, 40, and 42. For example, if he rolls two 5's, he may move five spaces following the red pathway 46 or five spaces following the white pathway 44. After completing his move (arriving in the corresponding colored zone and posting his popular votes), he must pick the top card from one of the two stacks of cards 62 and 63, as illustrated (they are known as "Money Card" and "Vote Card", respectively). He must follow its instructions and place the card face down at the bottom of the same stack.

(I) When a player rolls a combination of seven (7), (1 and 6, 2 and 5, 3 and 4) or eleven (11), (5 and 6), he gets a chance to pick a chance card 62 or 63.

(J) The player wins a state or D.C. when he has obtained the majority or plurality of votes required in each state or D.C. In each assigned colored playing zone for every state and D.C. on the game board, there is a guide as to the number of popular votes required to win.

(K) Upon winning a state or D.C., the Federal Election Commissioner or the player who wins it places a winning chip WC in the state or D.C. zone.

(L) According to the game in its present form, in order to become President, a player must have popular votes in a minimum of thirty (30) states and/or D.C. This can be altered by a change in the rules or it can be decided otherwise by a majority or plurality of the players before the beginning of the game.

(M) Outlying U.S. Areas—When landing in any one of these two colored playing zones 30 or 32, you do not have any opportunities to gain any electoral college votes there since these areas do not have any electoral college vote representation. The great majority of the inhabitants of these areas are U.S. citizens, a major number of them do not have the privilege of voting for the President of the U.S.A., nor can they elect Representatives with votes in the U.S. Congress. Because of that your stop in any one of these areas is considered as a vacation and/or strategy meeting stay with important aides of your campaign, and therefore you will pay one hundred thousand dollars ($100,000) for the expenses incurred every time you land in any one of them.

(N) Every time you win a state or D.C., you will have to pay for the expenses your campaign required in each one, and they are assigned as follows (they can vary):

| | |
|---|---|
| Green state | pay $100,000.00 |
| Yellow state | pay $200,000.00 |
| Orange state | pay $300,000.00 |
| Pink state | pay $400,000.00 |
| Red state | pay $500,000.00 |
| Blue state | pay $600,000.00 |
| Purple state | pay $1,000,000.00 |

(O) White House Area—Every time you land here, designated by 34, you are in for a briefing on national and international affairs by cabinet members and important presidential aides. Your stay in this area will oblige you to miss one turn, but you will be given two hundred thousand dollars ($200,000.00) every time you land here for the expenses and losses incurred.

(P) Money Matters—Any money that you collect due to game rules or card instructions, or any money that you have to disburse due to similar reasons, must be given to the Federal Election Commissioner (or designated banker) if it is not specified to whom it goes or from whom it comes.

DISCUSSION OF FIGS. 11 AND 12

Figure 12:
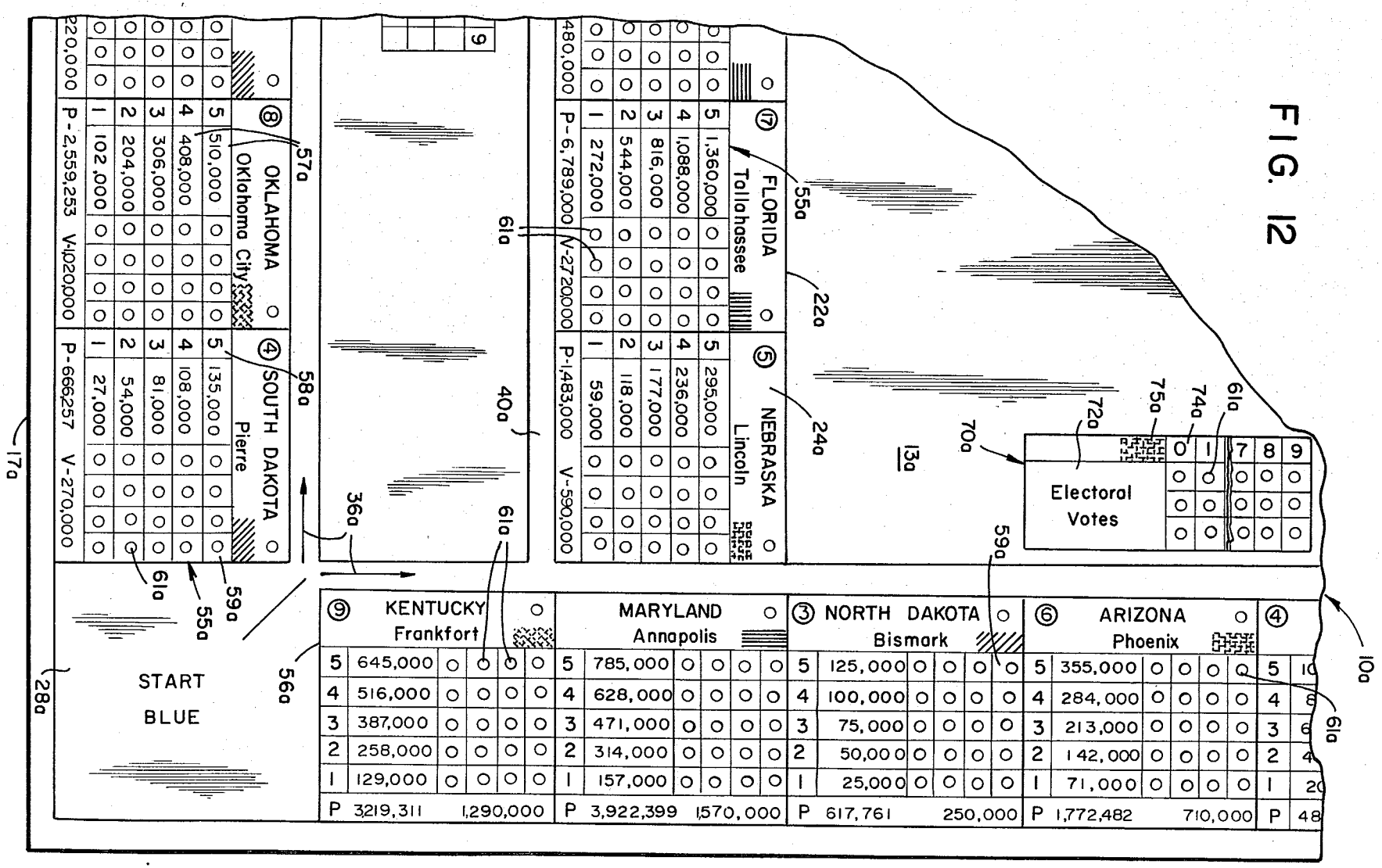
FIG. 12 is an enlarged fragmentary plan view of one corner of the board illustrated in FIG. 11, the lettering on the respective spaces or areas being clearly represented and the distinctive colors being indicated thereon according to the chart for draftsmen in the Patent Office Rules of Practice.

Referring to the drawings, FIGS. 11 and 12 illustrate another embodiment for the novel combination provided in the presidential election game 10*a* which includes a game board 12*a* made of any suitable material and being generally rectangular in configuration, having a playing surface 13*a* thereon. The playing surface 12*a* is provided with a central map 14*a* of the United States that would include all of the fifty states, as well as the District of Columbia. The game board 12*a* has sides 15*a*, 16*a*, 17*a*, and 18*a*. Around the periphery of the game board 12*a* are a series of outer or peripheral columns 19*a* of outer squares or zones 20*a* extending along each of the sides 15*a*, 16*a*, 17*a*, and 18*a* of the periphery of the game board 12*a*. The outer zones 20*a* of progression are arranged about each side 15*a*, 16*a*, 17*a*, and 18*a* of the periphery of the game board 12*a* to form a generally closed figure of four sides.

A first column 22*a* comprised of a series of inner zones 24*a* extends across the game board 12*a* and contiguous to a pair of columns 19*a* forming the outer zones 20*a* along spaced apart sides 16*a* and 18*a* of the game board 12*a*. A second column 26*a* comprised of a series of inner zones 24*a* extends across the playing board 12*a* in spaced apart substantially parallel spaced relation to the first column 22 of the inner zones 24*a* and contiguous to a pair of outer columns 12*a* forming the outer zones 20*a* along space apart sides 16*a* and 18*a* of the game board 12*a*.

A starting zone 28*a* on the game board 12*a* which is the starting position from which play of the game is commenced, is provided and may be at each corner of the board 12*a*. As illustrated in FIG. 11, the starting zones 28*a* are situated at each corner of the game board 12*a* for each player. Non-voting zones may be provided on the game board 12*a*.

To permit movement from the starting zones 28*a*, there is provided first lanes 36*a* connecting the starting zone 28*a* with the outer zones 20*a* and inner zones 24*a* on opposite sides thereof. In this manner a path of travel is available from each starting zone 28*a*. In addition, second lanes 40*a* are provided and extend between certain of the inner zones 24*a* and outer zones 20*a*.

Figure 10:
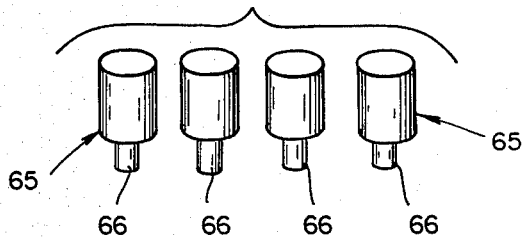
FIG. 10 is a perspective view of tabulating means for indicating the electoral or popular votes obtained by each player as the game progresses.

Voting or tabulation means 55*a*, as illustrated in FIG. 12, is provided in each of the zones 20*a* and 24*a* that is a state or the District of Columbia to aid in play of the game 10*a*. The voting means 55*a* includes indicating means 56*a* which may be in the form of a voting box having a series of horizontal columns 57*a* having indicating means or voting indicia 58*a* therein specified as numerals "1", "2", "3", "4", and "5". These numerals may represent 10%, 20%, 30%, 40%, 50%, respectively, of the electoral vote and/or popular vote of each voting area or zone. Adjacent to or forming part of the voting box 56*a* is a plurality of four vertically extending columns 59*a* extending in parallel spaced relationship to the voting indicia 58*a*. Four columns 59*a* are provided, one for each player. Each column 59*a* has a plurality of apertures or recesses 61*a* provided therein. Each recess 61*a* is adapted to receive the marking means in the form of indicators or elements as illustrated in FIG. 10.

As the game progresses, it is important that a tally is maintained of the votes each player is accumulating in the fifty-one voting areas, and accordingly posting means 70*a*, illustrated in FIGS. 11 and 12, is provided. The posting means 70*a* may be provided on the game board 12*a* and include horizontal columns 72*a* and cross-columns 74*a* with the numerals or numbers 1, 2, 3, 4, 5, 6, 7, 8, 9, and 0 thereon. The posting means 70*a* is provided adjacent the four corners of the gameboard to provide one for each player. The posting means 70*a* may be bounded by a posting box 75*a* as illustrated in FIG. 12 and include a plurality of apertures for which the marking elements may be used.

Accordingly, the posting means 70*a* is utilized for indicating the number of electoral votes posted by a player as the game progresses and includes the tabulation means 55*a* for the individual states.

RULES OF PLAY OF FIGS. 11 AND 12

The rules of play with respect to FIGS. 11 and 12 are substantially the same as those illustrated in FIGS. 1 and 2. The embodiment as illustrated in FIGS. 11 and 12 has a continuous pathway so as to facilitate the movement of the markers from zone to zone. by providing the tabulation means and the posting means directly on the gameboard it facilitates each player to maintain their own score and a quick determination when a person wins a particular voting area. For a game to be popular it should be both interesting and capable of being completed within a reasonable period of time. The inventor has found that the rules of play as it relates to FIGS. 11 and 12 may be streamlined such that in about one hour a full game could be completed and the President elected.

In addition the manner in which the votes are tabulated make the game exciting and readily visible for each player to see their own score. This totally provides a new and novel game.

Although illustrative embodiments of the invention have been described in detail herein with reference to the accompanying drawings, it is to be understood that the invention is not limited to the precise embodiments and that various changes and modifications may be effected therein without departing from the scope or spirit of the invention.

I claim:

1. A presidential election game for one of the players to win and thus become "President", said game comprises in combination:

A. a game board having a playing surface,

B. a series of outer zones extending along each side of the periphery of said game board, C. a first series of inner zones extending across said playing board and contiguous to said outer zones along spaced apart sides of said game board, D. a second series of inner zones extending across said playing board in spaced apart relation to said first series of inner zones and contiguous to said outer zones along spaced apart sides of said game board, E. said game board is generally square in configuration, said outer zones of progression are arranged about each side of the periphery of said game board to form a generally square closed figure of four sides, with said inner zones extending in substantially parallel spaced relationship to each other, and said inner zones terminate contiguous to said outer zones at each end thereof, F. said outer and inner zones comprising at least fifty-one voting areas comprised of the fifty States and the District of Columbia, G. numerical indicium contained on each one of said zones constituting a voting area, said numerical indicium being designative of the number of popular and/or electoral college votes allocated to each of said voting areas, H. chance means operable by players of the game apparatus so as to produce a random number for determining the percentage of votes accumulated by each player in each of said voting areas, and/or so as to produce a random number for determining the number of zones the player may advance, I. tabulation means formed on said game board for tallying the number of votes each player has accumulated on each one of said voting areas, J. a marker for each player that differs in color or configuration, said marker placed initially on one said zone by each player and progressively moving form zone to zone by utilization of said chance means and accumulating votes in order to win the election and become "President", K. indicating means on each one of said voting areas to obtain the number of votes the player has obtained on the player's usage of said chance means, L. said indicating means being in the form of a voting box having a plurality of parallel spaced apart columns with identification of each player, and as a result the player is given a total vote count obtained on each usage of said chance means in a particular one of said voting areas, M. pathways between adjoining zones on said game board, and N. said pathways being divided into a first group and a second group, said first group connecting certain contiguous zones, said second group connecting certain contiguous zones, and certain of said zones being connected by pathways of each of said groups.

2. A presidential election game as in claim 1, including:

a. posting means formed on said game board and used for indicating the number of popular and/or electoral college votes posted by each player as the game progresses, b. a posting box having a plurality of apertures therein formed in three parallel rows with numerals associated therewith to indicate a numerical amount, and c. a plurality of marking elements adapted to be placed on said posting means by insertion within said apertures for tallying said number of popular and/or electoral college votes obtained by each player.

3. A presidential election game as in claim 2, wherein said posting box includes a row of numerals of 0 through 9, inclusive, in substantial alignment with columns of said apertures.

4. A presidential election game as in claim 2, wherein said posting means is provided for each one of the players.

5. A presidential election game as in claim 1, including a. a set of chance cards positionable on said game board between one of said inner zones and a row of said outer zones adjacent one said side of said game board, each said chance card having indicia thereon representative of an advantage one player may exercise over another player or a hazard that a player must suffer, and b. distinguishable chips distributed to each of the players at the start of the game for use in conjunction therewith, said chips being placed upon a voting area that has been won by a player.

6. A presidential election game for one of the players to win and thus become "President", said game comprises in combination:

A. a game board having a playing surface,

B. a series of outer zones extending along each side of the periphery of said game board, C. a first series of inner zones extending across said playing board and contiguous to said outer zones along spaced apart sides of said game board, D. a second series of inner zones extending across said playing board in spaced apart relation to said first series of inner zones and contiguous to said outer zones along spaced apart sides of said game board, E. said outer and inner zones comprising at least fifty-one voting areas comprised of the fifty States and the District of Columbia, F. numerical indicium contained on each one of said zones constituting a voting area, said numerical indicium being designative of the number of popular and/or electoral college votes allocated to each of said voting areas, G. first chance means operable by players of the game apparatus so as to produce a random number for determining the percentage of votes accumulated by each player in each of said voting areas, H. second chance means operable by players of the game apparatus so as to produce a random number for determining the number of zones the player may advance, I. tabulation means formed on said game board for tallying the number of votes each player has accumulated on each one of said voting areas, J. posting means formed on said game board and used for indicating the number of popular and/or electoral college votes posted by each player as the game progresses, K. a marker for each player that differs in color or configuration, said marker placed initially on one said zone by each said player and progressively moving from zone to zone by utilization of said second chance means and accumulating votes by said first chance means in order to win the election and become "President", L. indicating means on each one of said voting areas to obtain the number of votes the player has obtained on the player's usage of said first chance means, and M. said indicating means being in the form of a voting box having a plurality of parallel spaced apart columns with identification of each player and a plurality of spaced apart apertures, and as a result the player is given a total vote count obtained on each usage of said first chance means in a particular one of said voting areas.

7. A presidential election game as in claim 6, and marking elements for each player adapted to be positioned in respective ones of said apertures by a player depending upon certain numbers obtained by said first chance means.

8. A presidential electron game as in claim 7, wherein said indicating means includes the numerals 1, 2, 3, 4, and 5, which represent 10%, 20%, 30%, 40% and 50%, respectively, of the votes in a voting area.

9. A presidential election game for one of the players to win and thus become "President", said game comprises in combination:

A. a game board having a playing surface,

B. a series of outer zones extending along each side of the periphery of said game board, C. a first series of inner zones extending across said playing board and contiguous to said outer zones along spaced apart sides of said game board, D. a second series of inner zones extending across said playing board in spaced apart relation to said first series of inner zones and contiguous to said outer zones along spaced apart sides of said game board, E. said outer and inner zones comprising at least fifty-one voting areas comprised of the fifty States and the District of Columbia, F. numerical indicium contained on each one of said zones constituting a voting area, said numerical indicium being designative of the number of popular and/or electoral college votes allocated to each of said voting areas, G. said zones being divided into different groups by color designation according to their population and/or electoral college votes representation, H. pathways between adjoining zones on said game board, I. first chance means operable by players of the game apparatus so as to produce a random number for determining the percentage of votes accumulated by each player in each of said voting areas, J. second chance means operable by players of the game apparatus so as to produce a random number for determining the number of zones the player may advance, K. tabulation means for providing the number of votes each player has acquired on each one of said voting areas, L. posting means for indicating the number of popular and/or electoral college votes posted by a player as the game progresses, M. a marker for each player that differs in color or configuration, said marker placed initially on one said zone by each said player and progressively moving from zone to zone by utilization of said second chance means through said pathways and accumulating votes by said first chance means in order to win the election and become "President", N. indicating means on each one of said voting areas to obtain the number of votes the player has obtained on the player's usage of said first chance means, and O. said indicating means being in the form of a voting box having a plurality of parallel spaced apart columns with identification of each player and a plurality of spaced apart apertures, and as a result the player is given a total vote count obtained on each usage of said first chance means in a particular one of said voting zones.

10. A presidential election game as in claim 9, a. said zones are divided into seven different color designated groups, and b. said number of zones in each said group varying from two up to sixteen.

11. A presidential electron game as in claim 9, and indicating means on each one of said voting areas to obtain the number of votes the player has obtained on the player's usage of said first chance means.

12. A presidential election game as in claim 9, and marking elements for each player adapted to be positioned in respective ones of said apertures by a player depending upon certain numbers obtained by said first chance means.

13. A presidential election game as in claim 12, wherein said indicating means includes the numerals 1, 2, 3, 4 and 5, which represent 10%, 20%, 30%, 40% and 50%, respectively, of the votes in a voting district.

14. A presidential election game as in claim 9, and money distributed to each of the players at the start of the game for use in conjunction therewith.

15. A presidential election game as in claim 9, and distinguishable chips distributed to each of the players at the start of the game for use in conjunction therewith, said chips being placed upon a voting area that has been won by a player.

16. A presidential election game as in claim 9, and one of said zones on said game board being the starting position from which play of the game is commenced.

17. A presidential election game as in claim 16, wherein a. said game board is generally square in configuration, said outer zones of progression are arranged about each side of the periphery of said game board to form a generally square closed figure of four sides, b. said inner zones extending in substantially parallel spaced relationship to each other, c. said inner zones terminate contiguous to said outer zones at each end thereof, and d. said starting zone is positioned intermediate one of said inner zones and said outer zones extending along one said side of said game board.

18. A presidential election game as in claim 17, including first lanes connecting said starting zone with said inner zones and said outer zones that extend on opposite sides thereof, such that a path of travel is available to each said marker from the starting zone.

19. A presidential election game as in claim 18, wherein said first lanes are divided into two distinguishable sets which are related to said second chance means which determines which of said two distinguishable sets of lanes each said marker can follow from said starting zone.

20. A presidential election game as in claim 19, including second lanes extending between each of said inner zones and said outer zones.

21. A presidential election game as in claim 20, wherein said second set of lanes are divided into two distinguishable sets which are related to said second chance means which determines which of said two distinguishable sets of lanes each said marker can follow between connecting ones of said zones.

22. A presidential election game as in claim 9, including a set of chance cards positionable on said game board between one of said inner zones and a row of said outer zones adjacent one said side of said game board, each said chance card having indicia thereon representative of an advantage one player may exercise over another player or a hazard that a player must suffer.

23. A presidential election game as in claim 9, said pathways being divided into a first group and a second group, said first group connecting certain contiguous zones, said second group connecting certain contiguous zones, and certain of said zones being connected by pathways of each of said groups.

24. A presidential election game as in claim 23, a. wherein said second chance means includes a die, b. a set of chance cards positionable on said game board between one of said inner zones and a row of said outer zones adjacent one said side of said game board, each said chance card having indicia thereon representative of an advantage one player may exercise over another player or a hazard that a player must suffer, and c. wherein said chance cards are picked by a player depending upon certain numbers obtained by said second chance means.

25. A presidential election game as in claim 24, wherein said die is coded, such that different surfaces thereof correspond to said pathways of said first group and said second group, such that movement of said marker by each player through said pathways is dependent on said die.

* * * * *